US006721435B2

(12) United States Patent
Babb et al.

(10) Patent No.: US 6,721,435 B2
(45) Date of Patent: Apr. 13, 2004

(54) ACOUSTIC LOUDSPEAKER WITH ENERGY ABSORBING BEARING AND VOICE COIL, AND SELECTIVE SOUND DAMPENING AND DISPERSION

(75) Inventors: Burton A. Babb, Dallas, TX (US); Alan J. Babb, Richardson, TX (US)

(73) Assignee: Babb Laboratories, Dallas, TX (US)

( * ) Notice: Subject to any disclaimer, the term of this patent is extended or adjusted under 35 U.S.C. 154(b) by 94 days.

(21) Appl. No.: 09/790,332

(22) Filed: Feb. 21, 2001

(65) Prior Publication Data

US 2001/0033673 A1 Oct. 25, 2001

Related U.S. Application Data

(60) Provisional application No. 60/184,973, filed on Feb. 25, 2000, and provisional application No. 60/184,110, filed on Feb. 22, 2000.

(51) Int. Cl.[7] ..... H04R 25/00

(52) U.S. Cl. ..... 381/407; 381/400

(58) Field of Search ..... 381/412, 419, 381/420, 406, 407, 409, 400

(56) References Cited

U.S. PATENT DOCUMENTS 4,297,537 A * 10/1981 Babb
4,378,471 A * 3/1983 Shintaku
6,111,969 A * 8/2000 Babb

* cited by examiner

*Primary Examiner*—Sinh Tran
(74) *Attorney, Agent, or Firm*—Marc A. Hubbard; Munsch, Hardt, Kopf & Harr, P.C.

(57) ABSTRACT

A loudspeaker having a flux gap defined by central pole and a magnet surrounding the central pole, includes a plurality of low-friction ridges extending from an outer surface of a the central pole. A voice coil, connected to the loudspeaker's diaphragm, is free to reciprocate within the flux gap. The ridges are linear and run generally in an axial direction, along a length of the pole where the voice coil reciprocates. Instead of rubbing directly against a metal pole, which has relatively high friction, the voice coil will rub against the ridges, thus reducing some of the noise that would otherwise occur due to rubbing. The voice coil includes a relatively stiff structure, created in part with a ceramic or epoxy material, that is coupled to a diaphragm, and a relatively flexible multiple layer structure at the terminating free end having dampening properties.

10 Claims, 3 Drawing Sheets

ACOUSTIC LOUDSPEAKER WITH ENERGY ABSORBING BEARING AND VOICE COIL, AND SELECTIVE SOUND DAMPENING AND DISPERSION

The present application claims benefit of U.S. Provisional Patent Application No. 60/184,973 entitled "Acoustic Loudspeaker with Energy Absorbing Bearing and Voice Coil, and Selective Sound Dampening and Dispersion," filed Feb. 25, 2000 and U.S. Provisional Patent Application No. 60/184,110 entitled "Acoustic Loudspeaker with Energy Absorbing Bearing and Voice Coil," filed Feb. 22, 2000.

FIELD OF THE INVENTION

The invention relates to acoustic loudspeakers.

BACKGROUND OF THE INVENTION

To provide the greatest listening pleasure, an acoustic loudspeaker system should strive to meet several basic requirements. First, it must be capable of reproducing very low frequencies, typically below 30 Hz, that are felt and not heard. Second, it must be capable of reproducing overtones of high musical notes. Third, it should have a relatively flat frequency and phase response over the full range of human audible frequencies, from about 20 Hz to about 20,000 Hz in order to reproduce sound with fidelity to the source. Fourth, also to be faithful to the source, the system should recreate whatever spatial illusions are contained in the source material. For example, most music sources are encoded for stereo reproduction using two channels. Two, spatially separated and phase-synchronous infinitesimal point sources of acoustic energy theoretically provide the best stereo imaging. These types of sources are able to create the illusion of sound originating from any point along a line extending through both point sources. Therefore, a loudspeaker system for stereo encoded audio sources should imitate as closely as possible two infinitesimally small point sources of acoustic energy. Fifth, to accommodate wide dynamic ranges, a loudspeaker system must be able to handle signals with power sufficient to reproduce low frequencies at loud volumes without distortion to the sound or damage to the speaker.

Conventional belief is that a single acoustic driver cannot deliver a frequency range and power handling capability required for high fidelity sound reproduction demanded by audiophiles. Characteristics of a transducer that optimize it for high frequency sound reproduction are often opposite of those that are optimum for a driver for low frequency reproduction. Therefore, most loudspeaker systems rely on two or more acoustic transducers or drivers per channel. Each driver of a channel is responsible for reproducing sounds in only in certain portions of the audible range. By utilizing multiple drivers per channel, each driver may be optimized to operate within a selected portion of the acoustic range. An electrical circuit, known as a cross-over network, splits portions of the energy of the input signal between the drivers based on its frequency and feeds it to the different driver.

Despite their widespread acceptance, multi-driver speakers have several drawbacks. First, cross-over networks distort the electrical sound signal, thus introducing distortion into the sound reproduced by the loudspeaker system. For example, cross-over networks naturally cause phase distortion in incoming signals: higher frequencies will be phase shifted with respect to the lower frequencies. Phase shifting results in a loss of imaging information, causing the music to sound "muddy." Cross-over networks therefore sometimes employ circuits to correct phase distortion. These cross-over networks will often introduce other types of distortion and possess non-linear responses. Second, multi-driver speaker systems tend to be larger and have more components, thus making them more expensive, bulkier and less mobile. Third, a multi-driver speaker does not satisfactorily represent a point source of acoustic radiation for a single channel, as a channel is obviously radiating from multiple points. Thus, they cannot achieve the best stereo imaging.

Despite the motivation for creating a broadband acoustic driver, the problems of using a single driver to reproduce at equal levels high notes with clarity and low notes with physical impact have been difficult to overcome.

A conventional acoustic transducer has a relatively stiff or rigid diaphragm which reciprocates along a linear axis. For reproducing low frequencies, the diaphragm has preferably a concave, cone shape. For high frequencies, it may be flat or convex. To vibrate the diaphragm, an electrical signal representing the sound wave to be reproduced flows through a coil mechanically connected to the diaphragm. The coil is situated within a fixed magnetic field, causing the coil to reciprocate with changes in the current. The coil is formed from one or more lengths of wire wrapped around a support structure. Typically, the edges of the diaphragm are attached to a basket shaped frame using a compliant, slightly resilient, material. The coil is centered within a gap referred to as a "flux gap," formed between cylindrically shaped pole and a donut-shaped magnet assembly.

To provide the most accurate sound reproduction, the movement of the coil in response to the electrical signal and the coupling of the movement of the diaphragm to the air in response to the movement of the coil must be linear. Unfortunately, the responses of these elements to the sound signal are rarely totally linear, especially over the entire audible range. The diaphragm couples the mechanical energy of the moving coil to the air, thereby causing the air to vibrate and setting up acoustic waves. At lower frequencies, the diaphragm can be thought of as behaving like a simple mechanical piston pushing volumes of air. At low frequencies, a lot of power is required to push large volumes of air, particularly at loud volumes. Therefore, to sound low notes with great volume a speaker must be capable of handling a lot of power, particularly the mechanical stresses from the strong electromagnetic forces and resulting heat.

For good low frequency response, a driver is needed which is mechanically strong and powerful in order to move larger amounts of air. Thus, a stiffer diaphragm with a large surface area is preferred. However, a large, stiff diaphragm means more structure, and thus more mass. More mass means less efficiency, and thus more power to reproduce the same loudness. More power means that a more massive coil is required to handle the mechanical and thermal stresses resulting from the power. However, more mass in the moving parts inhibits the driver's ability to reciprocate at higher frequencies. Also, it is more difficult to control coupling of the movement of the coil to the air through a large diaphragm and its natural resonances. A smaller diaphragm could be used to sound bass notes, but a longer throw or stroke of the coil would be required to move the same amount of air. However, a longer stroke necessitates either a magnetic field of greater magnitude or a longer coil in order to provide a sufficiently high electromotive force (EMF). Furthermore, a greater coil length means greater induction. Thus, the length of the coil is limited. A long stroke also requires the coil to move at a higher velocity. Higher velocities will create a higher back EMF, which resists travel of the coil and ultimately limits the ability of the driver to reproduce low frequencies.

At higher frequencies, the diaphragm behaves more like a radiating transmission line. The rapid vibrations of the coil cause not only linear movement of the diaphragm, but also mechanical vibrations in the diaphragm which radiate from the points where the coil is attached, outwardly to the edge of the diaphragm. Depending on the material, size of the diaphragm and how it is attached to the suspension, these vibrations may resonate at certain audible frequencies, thus adversely affecting the linearity of the coupling of the mechanical movement of the coil to the air. Although there may be mechanical deformation of the diaphragm at all frequencies, at high frequencies the effect of resonant vibrations will have a substantial impact on the sound, with certain frequencies being noticeably enhanced and others degraded. Reproducing a high frequency sound also requires the coil to be quickly accelerated. Thus, a near zero mass coil and diaphragm is theoretically ideal. Furthermore, a smaller diameter diaphragm is preferred. A larger diameter diaphragm tends to be more directional, exacerbating the directional nature of high frequencies.

Attempts have been made to accommodate the demands of high and low frequencies in a single, broad band acoustic driver, particularly in the area of reducing the mass of the moving parts of the driver. For example, as shown in U.S. Pat. Nos. 4,115,667 and 4,188,711 of Babb, the conventional rear suspension for the coil is replaced with a low friction bearing made of TEFLON®. The bearing is formed at the bottom of the coil, opposite of where it connects to the diaphragm, and encircles and rides on the post. The coil remains centered within the gap without the extra mass of the rear suspension and its spring forces interfering with movement of the coil. The coil therefore can move more freely and accelerate faster, which aids in moving the coil long distances when using a longer throw coil to sound bass notes. A low friction bearing can also be added around the circumference of the top end of the post. Lightweight, stiff metal alloys have been used to form diaphragms. Coil forms (structures for supporting windings of coils) have been made from high strength, thermally resistant materials such as KAPTON®. To provide a low mass, compliant suspension for the diaphragm, a stamped synthetic foam having a very low density with good dampening and resonance characteristics is used.

Nevertheless, although not recognized in the art, there still exist problems. One such problem comes from the fact that a coil undergoes great mechanical stress from the EMF generated by the magnet and the current running through the coil, as well as great thermal stress from the substantial heat generated when large currents flow through the coil during reproduction of loud notes. Despite the use of lightweight, stiff materials, a low mass coil capable of sounding both high and low frequencies will naturally tend to be weaker and thus more easily deformed by the mechanical and thermal stresses present during reproduction of high power sounds. A low mass coil also cannot store heat for later dissipation. Thus, during extended periods of loud notes, a low mass coil will tend to get very hot and possibly damaged. Furthermore, TEFLON® is not structurally strong and tends to shrink in heat, thus resulting in increased drag of the coil's bearing on the post and deformation under high thermal and mechanical loads. A deformed coil cannot sound notes as accurately and will tend to rub against the walls defining the flux gap, causing noticeable distortion of low notes and extraneous noises at midrange frequencies.

When a full range driver is designed to have a flat frequency response over the entire audible range (20 Hz to 20,000 Hz) it must have a large enough diaphragm to displace enough air to produce the low frequency notes (20 Hz to 60 Hz) at adequate sound pressure levels. This minimum size places a heavy burden on achieving adequate performance in the high frequency range (5000 Hz to 20,000 Hz). If this driver is made with a metal cone, for optimum strength to mass properties, it tends to resonate or "ring" at certain high frequencies. This resonance can be heard by, and is objectionable to, most audiophiles. As the size of the metal cone grows it becomes more difficult to control these resonance's.

Another problem associated with this minimum diaphragm size is that, the larger the diaphragm, the more difficult it is to achieve a smooth angular dispersion pattern over the entire audible frequency range. An even dispersion pattern is required for a loudspeaker driver to function like an ideal point source driver, and to thus achieve a truly accurate audio image that extends beyond a narrow "sweet spot" to cover the whole vertical and horizontal area in front of a pair of audio drivers.

SUMMARY OF THE INVENTION

One objective of the invention is to improve performance of an acoustic driver by overcoming one or more of the aforementioned problems. An example of loudspeaker employing the invention, in its preferred embodiment, is summarized below.

To overcome the problem of extraneous noises introduced by a voice coil caused by mechanical deformations in the voice coil and its misalignment with a cylindrical element on which it reciprocates, an acoustic driver of a loudspeaker is provided with a plurality of ridges that extend from an outer surface of the cylindrically-shaped element. (The cylindrical element may take the form of a solid or hollow pole, and may include a sleeve over the pole.) The ridges are linear and run generally in an axial direction, along a length of the pole where the voice coil reciprocates. Each ridge has a low friction surface. Instead of rubbing directly against the cylindrical element, the voice coil will rub against the ridges, thus reducing some of the noise that would otherwise occur due to rubbing. Additionally, each ridge may be made compressible to absorb some of the energy associated with the forces on the voice coil as it moves toward the pole.

In one disclosed embodiment of an acoustic driver employing this feature, each ridge is oriented in a helical fashion about the pole. With this arrangement, the flow of air along the pole that is caused by displacement of a voice coil within an air gap formed between the pole and a surrounding magnetic structure is not blocked, while providing greater chance that the coil contacts more than one ridge. The resiliency of the compressible ridges, and thus their energy absorbing effect, can be altered based on the internal structure of the ridge.

Another feature of the loudspeaker directed to overcoming the problem of extraneous noise is a voice coil that has a relatively stiff structure, created in part with a ceramic or epoxy material, that is coupled to a diaphragm, and a relatively flexible multiple layer structure at the terminating free end having dampening properties. The structure includes, in a preferred embodiment, two layers of Kapton® tape, each a flexible sheet of material possessing good tensile strength, between which is wound a portion of the coil. The layers of tape that extend beyond the rearward portion of the coil are held together by a tacky silicon adhesive to provide viscous dampening of the relative movement of the two layers.

Generally, it is preferred that a coil be stiff in order to provide a good coupling of its translational energy to the diaphragm. However, the coil will tend to resonate at frequencies determined in part by the stiffness of the coil. With a hard end and a soft end, an impedance mismatch is set up, dampening the resonance. Furthermore, a dampened flexible end of the coil acts as a non-reflective termination. This keeps the audio frequency energy that is generated by the coil from being reflected back from the end of the coil. The energy reflected be a hard, reflective boundary would be phase shifted and would cause peaks and valleys in the loudspeaker frequency response. Furthermore, when used in combination with compressible ridges on a pole that acting as bearings, two relatively soft and dampened structures will interact, further reducing the noise caused by rattling. The flexible structure also possesses, in a preferred embodiment, a thin tapered end for the coil that reduces the turbulence and air friction that results from the bottom end of the coil being pushed and pulled through the air. Less turbulence means less noise is generated, less friction means more efficient operation.

DETAILED DESCRIPTION

In the following description, like numbers refer to like parts.

Figure 1:
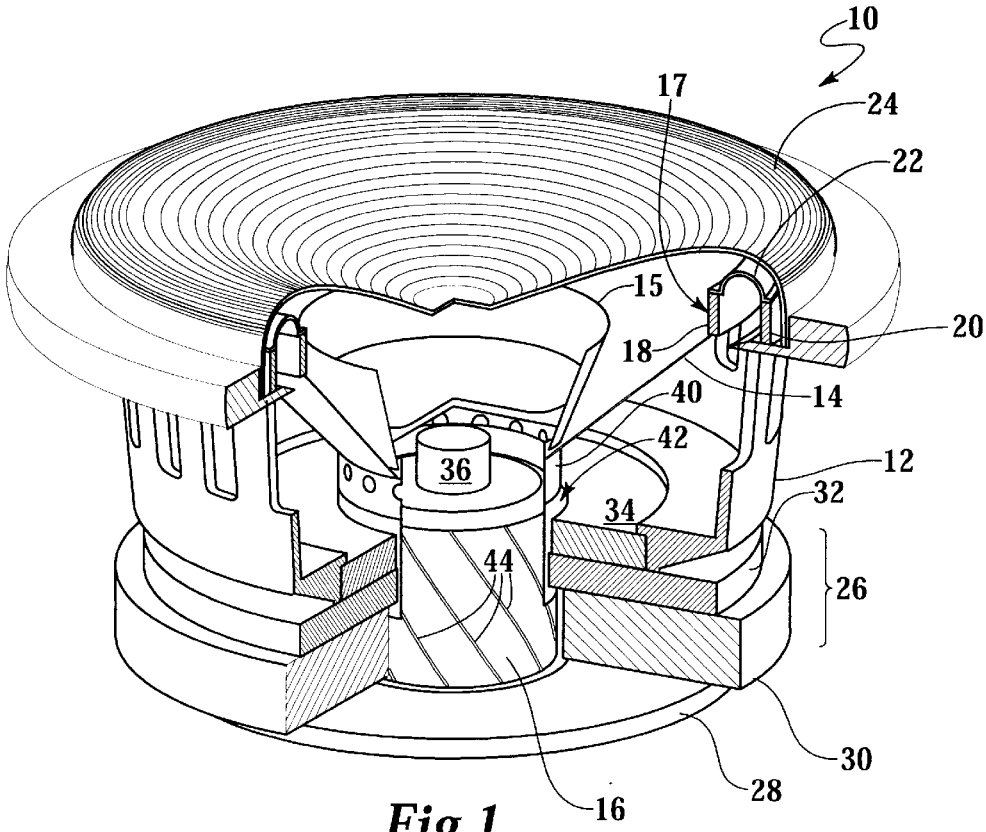
FIG. 1 is an isometric view of an acoustic transducer that is partially sectioned.
Figure 2:
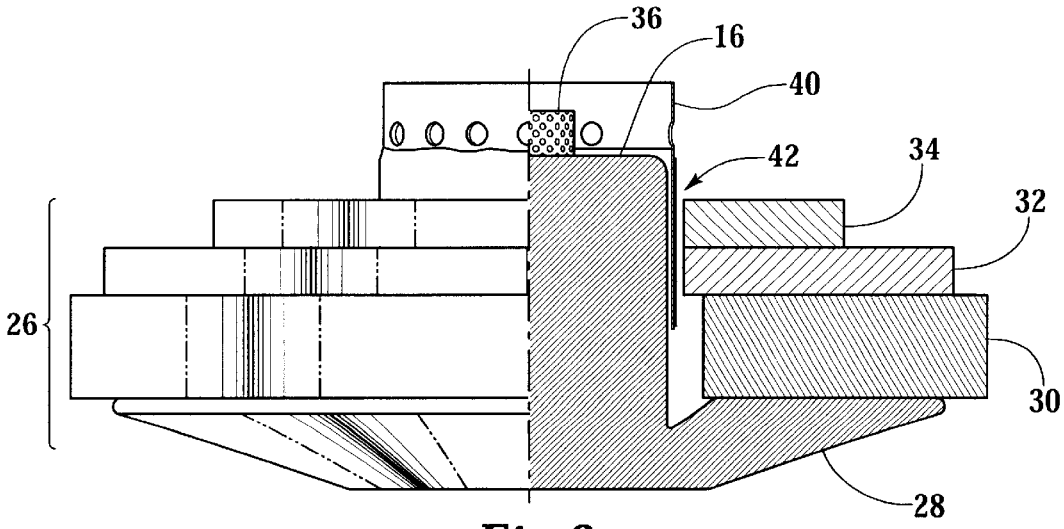
FIG. 2 is a side view of a magnet and voice coil assembly of the acoustic transducer of FIG. 1 that is partially sectioned.

Referring to FIGS. 1 and 2, acoustic transducer 10 includes a frame 12, in the shape of a basket, from which is suspended a diaphragm 14, which is in the shape of a cone. Collar 15 enhances coupling of high frequency movement of the diaphragm to the air. Suspension 17 allows the diaphragm to move linearly in a reciprocating fashion along an axis defined by a center of cylindrical pole 16. The suspension includes two, compressible foam rings 18 and 20 and a foam roll 22. Foam ring 18 is attached to an outer circumference of cone; foam ring 20 is attached to the frame. The foam ring compress, stretch and bend to accommodate movement of the cone during its excursions, but otherwise function to keep the cone substantially centered within the frame. A perforated grille 24 covers the speaker to protect it from physical damage.

Magnet assembly 26 includes a bottom steel plate 28, a magnet 30 and two steel top plates 32 and 34. The magnet and top plates have a center hole and form a donut shape through which pole 16 extends. Pole 16 is attached to or, as shown, integrally formed with plate 28. Frame 12 is attached to top plate 34. A foam button 36 acts as a bumper to stop downward excursion of the diaphragm and to prevent end of voice coil from hitting the back plate 28. A voice coil assembly reciprocates in a conventional, linear fashion within a cylindrically shaped, annular flux gap 42 formed between pole 16 and the inside surfaces of donut shaped magnet assembly 26.

Formed at regularly spaced intervals around the circumference of pole 16 are a plurality of ridges 44. Each ridge is oriented in the general direction of the axis of the pole and movement of the voice coil assembly , but turned at an angle, resulting in the ridges running in an helical fashion. The plurality of ridges are referred to herein as a linear bearing. With this helical arrangement of the ridges, when the coil assembly touches a ridge, the coil assembly is typically very close to touching or is touching another, adjacent ridge.

Figure 3:
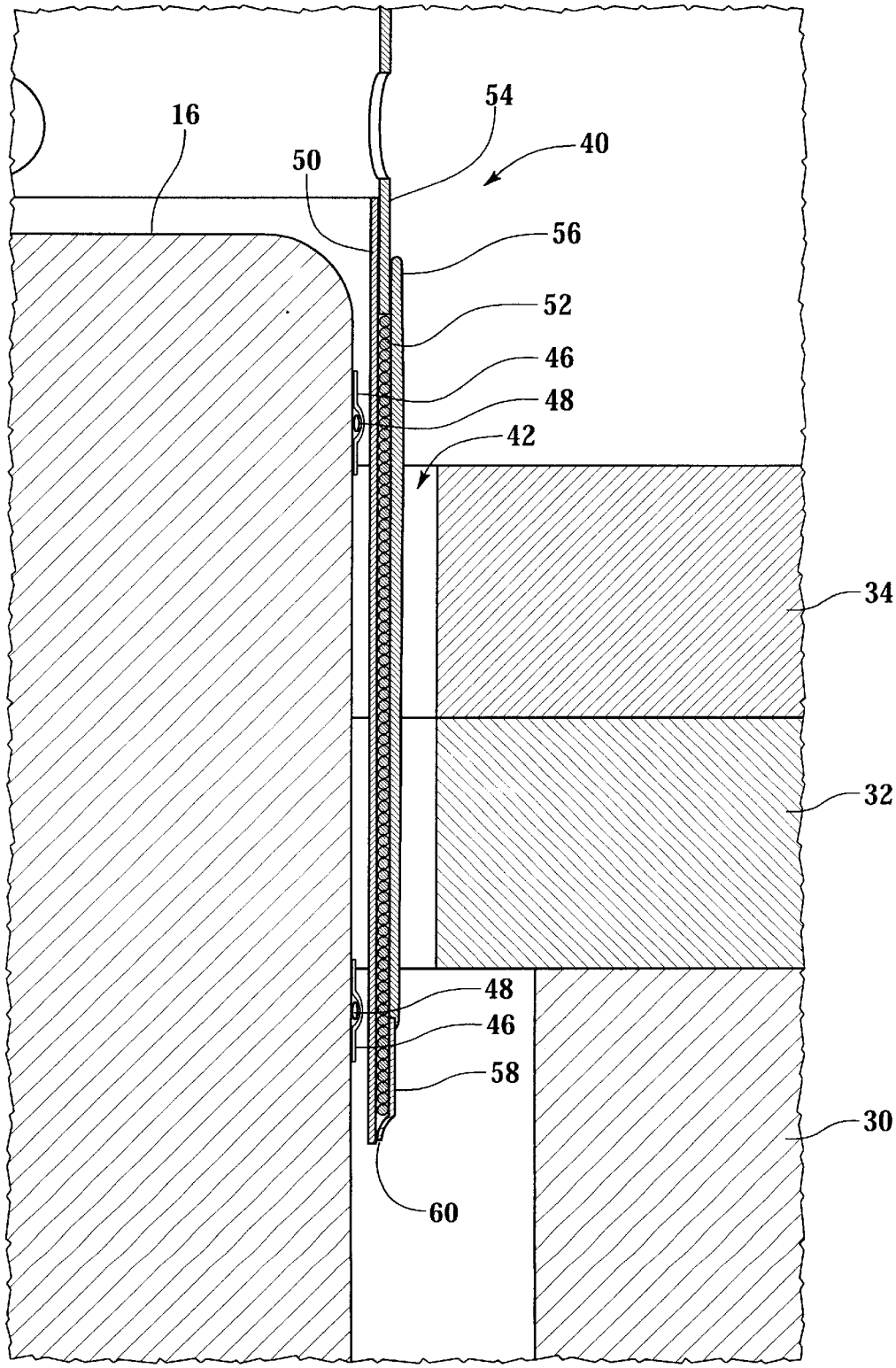
FIG. 3 is an enlargement of the sectioned portion of the voice coil and magnet assembly of FIG. 2.

Referring to now to FIG. 3, each ridge has a low friction outer surface. Furthermore, it is preferred to be compressible. It is formed, in the preferred embodiment, using 0.002" thick Teflon® tape 46 overlaying a 0.007" diameter cotton thread 48. However, the compressibility and resiliency can be altered by using different core materials, if desired. By keeping the ends of the ridges open and using a relatively porous cotton thread, air trapped within the ridge can act as a dampening mechanism. The cotton thread acts to create resistance to slow the flow of air our of the ridge as it is being displaced. Additionally, as the coil is likely to engage a length of each of two adjacent ridges when it hits the post, air is momentarily trapped between the adjacent ridges and can only escape by flowing in a generally axial direction along the pole. Confining the flow of air in this fashion may also tend to dampen lateral movement of the coil toward the pole. The larger the lateral forces, the more the ridge and the surrounding air is compressed and the larger the lateral dampening.

Coil assembly 40 is formed by wrapping an appropriately shaped form (not shown) first with a base layer 50 of dielectric material of high mechanical and thermal strength. One example of such material is a tape sold under the trademark KAPTON®. Such material does not contract or stretch under the temperatures sometimes created by periods of high power consumption by the coil assembly. One or more lengths of insulated wire are wound over the base layer 50 to form a coil 52. The terminating ends of the wire are not shown. However, they are coupled to an audio signal source through connectors (not shown) on the driver. A tube 54 made of a light weight metal alloy provides a stiff, structural member for transferring mechanical forces to the diaphragm 14 from the windings of coil 52. The windings of the coil and an end portion of tube 54 are then sandwiched between the base layer 50 along an upper end of the coil assembly by stiffening layer 56. The stiffening layer cooperates with the base layer 50 to form a structure which resists buckling in the upper half of coil assembly that may be caused by mechanical forces acting on the coil in the direction of its axis. The stiffening layer is made of a high mechanical strength dielectric material, such as a high temperature ceramic. This stiffening layer runs most of the length of the coil.

However, the terminating, free end of the coil is covered in a second layer 58 of high strength, lightweight dielectric material. Both the inner layer 50 and the outer layer 58 are, as compared to stiffening layer 56, relatively flexible. Outer layer 58 does not extend the length of the coil, under the stiffening layer in order to provide an even stiffer top end of the coil assembly. This combination is relatively soft and flexible and has a relatively large amount of viscous dampening to create a terminating bottom end with a substantially different resonance frequency than the very stiff top end of the coil. This resonance differential that acts as an impedance mismatch that tends dampen resonance in the coil. Since it is relatively soft, the free end of the assembly does not create as much noise when it hits against the side of the pole. Furthermore, an extra length of the inner and outer layers is included so that they may be bonded together to form a point 60 at the terminating or free end of the coil assembly 40 to reduce air resistance. In a preferred embodiment, the inner and outer layers are formed using KAPTON® tape having a silicon adhesive applied to one side. Each layer of KAPTON® includes an adhesive applied to one side, resulting in a double thick layer of silicone adhesive between the two layers of KAPTON®.

Figure 4:
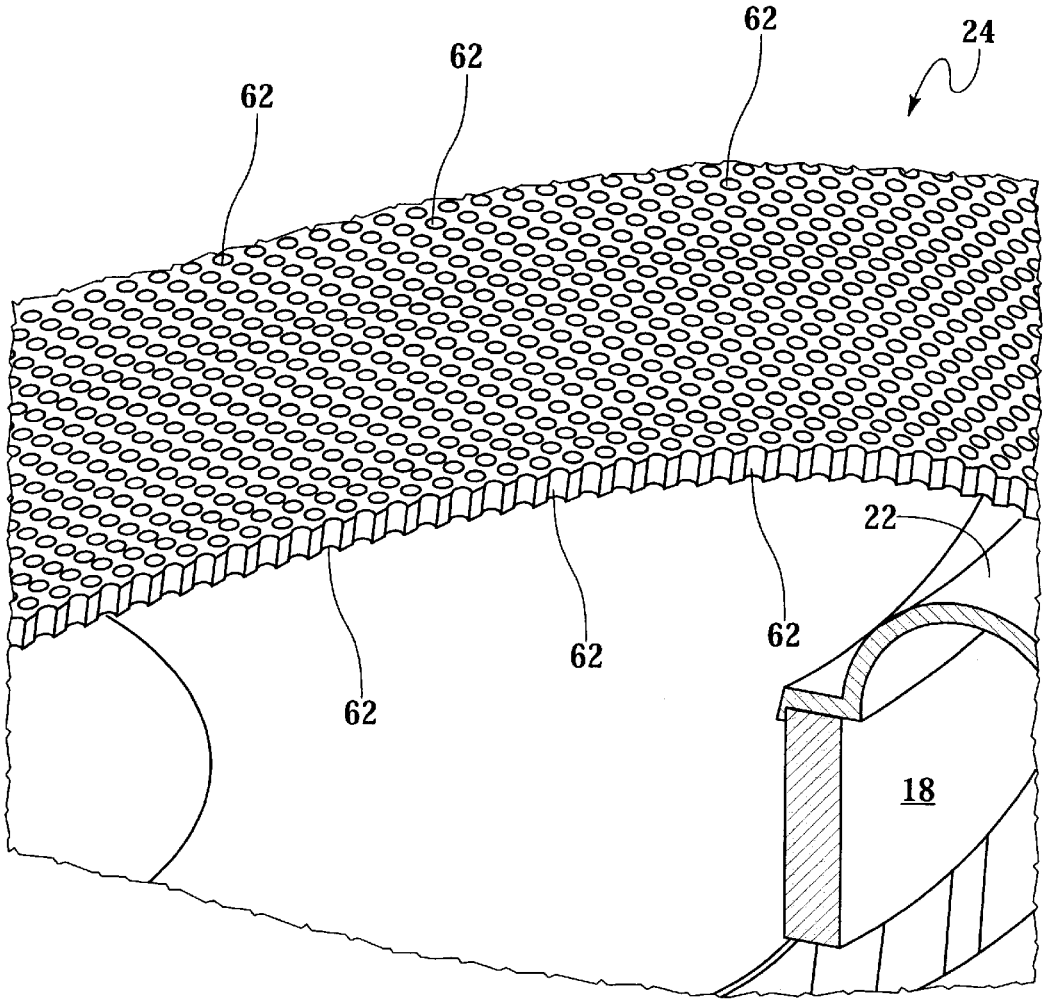
FIG. 4 is an enlargement of a portion of a cross section of a grille cover of the transducer of FIG. 1.

Referring now to FIGS. 1 and 4, grilles have been placed in front of speakers for cosmetic and protective reasons for many years. These grilles have been chosen to have the least negative effects in both dampening of the driver and reducing the angular dispersion of the driver. However, experimental tests indicate that grille 24 provides positive dampening of certain frequencies of acoustic energy generated by the loudspeaker and also improves the angular dispersion pattern of the speaker as a result of a combination of its shape, material, thickness, and hole pattern. One preferred embodiment of the grille is made of 0.050" to 0.065" high temperature ABS, such as Royalite®, which has been perforated with 0.085" holes on staggered 0.125" centers and then thermoformed to the illustrated shape. In cross-section through the driver's center axis, the grille possesses a continuously curved surface between the axis of the driver and its outer diameter.

At frequencies approximately 3000 Hz and higher, the solid areas between perforations 62 of the grille starts to reflect acoustic waves and the perforations start to act as tuned ports or drivers. Each of the perforations form a hollow tube of a certain length and diameter that resonates at the higher frequencies. These tubes are formed so that the axis of the tube is normal to the plane of the surface of the grille at the opening of the tube. As high frequency acoustic energy is directional, the continuously curved shape of the grille creates a dispersion pattern for high frequency acoustic signals that has a comparatively wide spherical angle.

Furthermore, based on experiments, the grille tends to dampen the "ring" associated with a metal diaphragm. One explanation for this is that energy that reflects off the grille and towards the diaphragm 14 loads the diaphragm. When the distance between the diaphragm and the grille is an integral number multiple of ¼ wavelengths of the reflected energy, resonance in the diaphragm will tend to be dampened by this loading because the reflected energy loading the diaphragm will be 180 degrees out of phase with the resonance in the diaphragm. In a preferred embodiment, the distance between the grille and the diaphragm varies smoothly from approximately 0.25" to 1", and provides enough cone dampening in one preferred embodiment so as to effectively control the "ring" in a metal diaphragm.

The suspension of the driver (foam rings 18 and 20, and foam roll 22) may be made very compliant because the grille acts as a physical stop for the moving mass of the driver. The suspension will tend to hit the grille before the voice coil 40 moves out of the magnetic gap 42. Because the material that is hitting the grille is soft it compresses and stops the forward travel of the moving mass in a smooth and non-damaging fashion.

What is claimed is:

1. A loudspeaker comprising, a diaphragm coupled to a reciprocating voice coil;

a magnet assembly defining a flux gap in which the voice coil reciprocates, the magnet assembly including a cylindrical element on which the voice coil reciprocates, the cylindrical element having formed on an exterior surface thereof a plurality of spaced-apart, low-friction ridges extending along the cylindrical element's length, generally in the directions of its axis;

wherein each of the plurality ridges are resiliently compressible to absorb some of the energy associated with the forces on the voice coil as it moves toward the pole.

2. The loudspeaker of claim 1, wherein the voice coil includes a structure having two layers flexible material possessing good tensile strength, between which is wound at least one wire and wherein the layers of flexible material extend beyond a rearward portion of the at least one wire to form a flexible end portion.

3. The loudspeaker of claim 2, wherein the voice coil further includes a stiff end portion for coupling to the diaphragm that is opposite the flexible end portion, whereby there exists an impedance mismatch between opposite ends of the voice coil for dampening resonance.

4. The loudspeaker of claim 2 wherein the flexible end portion has a relatively thin, tapered end for tending to reduce turbulence and air friction resulting from the voice coil reciprocating.

5. The loudspeaker of claim 2, wherein the layers of flexible material are held together, at least in part, by a tacky adhesive in order to provide viscous dampening of the relative movement of the two layers at the flexible end portion.

6. A loudspeaker comprising, a diaphragm coupled to a reciprocating voice coil;

a magnet assembly defining a flux gap in which the voice coil reciprocates, the magnet assembly including a cylindrical element on which the voice coil reciprocates, the cylindrical element having formed on an exterior surface thereof a plurality of spaced-apart, low-friction ridges extending along the cylindrical element's length, generally in the directions of its axis;

wherein each of the plurality of low-friction ridges are oriented in a helical fashion about the pole.

7. The loudspeaker of claim 4, wherein the voice coil includes a structure having two layers flexible material possessing good tensile strength, between which is wound at least one wire and wherein the layers of flexible material extend beyond a rearward portion of the at least one wire to form a flexible end portion.

8. The loudspeaker of claim 7, wherein the voice coil further includes a stiff end portion for coupling to the diaphragm that is opposite the flexible end portion, whereby there exists an impedance mismatch between opposite ends of the voice coil for dampening resonance.

9. The loudspeaker of claim 7, wherein the flexible end portion has a relatively thin, tapered end for tending to reduce turbulence and air friction resulting from the voice coil reciprocating.

10. The loudspeaker of claim 7, wherein the layers of flexible material are held together, at least in part, by a tacky adhesive in order to provide viscous dampening of the relative movement of the two layers at the flexible end portion.

* * * * *

UNITED STATES PATENT AND TRADEMARK OFFICE

CERTIFICATE OF CORRECTION

PATENT NO. : 6,721,435 B2
DATED : April 13, 2004
INVENTOR(S) : Babb et al.

It is certified that error appears in the above-identified patent and that said Letters Patent is hereby corrected as shown below:

Column 5,
Line 45, please change “17” to -- 16 --; and
Line 51, please change “ring” to -- ring --.

Signed and Sealed this

Twenty-first Day of December, 2004

JON W. DUDAS
*Director of the United States Patent and Trademark Office*